US006036445A

United States Patent [19]

Reynolds

[11] Patent Number: 6,036,445

[45] Date of Patent: Mar. 14, 2000

[54] ELECTRIC SHIFTING MECHANISM/ INTERFACE FOR FLUID POWER DIAPHRAGM PUMPS

[75] Inventor: Steven M. Reynolds, Lucas, Ohio

[73] Assignee: Warren Rupp, Inc., Mansfield, Ohio

[21] Appl. No.: 09/032,541

[22] Filed: Feb. 27, 1998

[51] Int. Cl.[7] ..... F04B 43/06

[52] U.S. Cl. ..... 417/53; 417/395

[58] Field of Search ..... 417/53, 395, 505, 417/418, 393, 43, 293; 91/275, 313

[56] References Cited

U.S. PATENT DOCUMENTS

| | | | |
|---|---|---|---|
| 4,345,442 | 8/1982 | Dorman | 62/160 |
| 4,472,115 | 9/1984 | Rupp | 417/393 |
| 4,778,356 | 10/1988 | Hicks | 417/397 |
| 5,076,890 | 12/1991 | Balembois | 162/198 |
| 5,174,731 | 12/1992 | Korver | 417/393 |
| 5,249,932 | 10/1993 | Van Bork | 417/386 |
| 5,257,914 | 11/1993 | Reynolds | 417/293 |

*Primary Examiner*—Thomas N. Moulis
*Assistant Examiner*—Mahmoud M. Gimie
*Attorney, Agent, or Firm*—Hill & Simpson

[57] ABSTRACT

An electric shifting mechanism for a fluid-powered diaphragm pump is provided. The shifting mechanism includes a controller programmed to switch the pump at timed intervals, a solenoid valve and an end of stroke valve. The end of stroke valve translates the pneumatic end of stroke signals generated by the pilot valve into electric signals. The electric signals are then transmitted to the controller. The controller sends timed switch signals to an operator of the solenoid valve. The operator shifts the solenoid valve which transmits a pilot signal generated from the compressed air supply to either the right or the left pilot signal port of the main air valve. The main air valve does not receive pilot signals directly from the pilot valve but, in turn, receives its pilot signals from the solenoid valve which receives signals from the controller. The controller receives end of stroke signals from the end of stroke valve which translates the pneumatic signals generated by the pilot valve into electric signals. The controller than compares the end of stroke signals received from the end of stroke valve with the pre-programmed timed intervals and provides an indication or an alarm if the controller is programmed to shift the pump before the pump reaches the end of its stroke. The solenoid valve and end of stroke valve may be easily incorporated into existing pumps.

22 Claims, 5 Drawing Sheets

ELECTRIC SHIFTING MECHANISM/ INTERFACE FOR FLUID POWER DIAPHRAGM PUMPS

FIELD OF THE INVENTION

The present invention relates generally to diaphragm pumps, and more specifically, to fluid power diaphragm pumps. Still more specifically, the present invention relates to an electric mechanism and interface for diaphragm pumps which may be used as original equipment or which may be used to retrofit the pneumatic shifting mechanism of an existing diaphragm pump to an electric shifting mechanism and to provide an interface to a control and/or monitoring system.

BACKGROUND OF THE INVENTION

Fluid diaphragm pumps are known. Typically, diaphragm pumps must be shifted pneumatically using signals generated by a pilot valve which, in turn, shifts a ain air valve which thereafter directs the compressed air that powers the pump into the appropriate chamber. Thus, the combination of the air pressure, the pilot valve and the main air valve control the timing of the pump.

Other designs incorporate an external signal to shift the pump. Typically, these designs involve the use of a timer or a timer incorporated into a controller or processor. However, timers have been found to be problematic because the timing imposed by the timer may not correspond exactly with the timing of the pump. For example, if the timed interval provided by the timer is too short, the pump will not go through a full stroke. Conversely, if the timing interval provided by the timer is too long, the pump will cycle but will not pump at full displacement or at a high efficiency. In some cases, the pump will not pump at all. Further, there is no current system which provides feedback to the operator when the timer has been set to a time interval that is either too short or too long, i.e. an interval that does not result ir the pump displacing full strokes.

However, the use of external electric signal to shift a diaphragm pump would be advantageous because the shifting of the pump could be monitored by a control system and knowledge of the shifting rate is useful information for operation of both the pump and the overall system in which the pump is incorporated.

Further, because of the large number of fluid powered diaphragm pumps currently in use, it would be very advantageous to provide an electric shifting mechanism which could be incorporated into existing fluid power diaphragm pumps. Preferably, the same pilot valves and main air valves could be used with a new electric shifting mechanism.

Accordingly, there is a need for an electric shifting mechanism for fluid power diaphragm pumps. Further, there is a need for an electric shifting mechanism for fluid power diaphragm pumps which could be incorporated into existing fluid power diaphragm pumps or provided in the form of a retrofit kit. Still further, there is a need for an electric shifting mechanism for diaphragm pumps which could be easily incorporated into a control system for easily monitoring the operation of the pump.

SUMMARY OF THE INVENTION

The present invention satisfies the afore-noted needs by providing a switching mechanism and interface for a diaphragm pump that comprises a solenoid valve that receives signals from an operator control system and an end of stroke valve that sends a signal to the control system when the pump is at the end of its stroke. Typically, a main fluid valve and a pilot valve are provided in the form of a new fluid power diaphragm pump or a pre-existing fluid power diaphragm pump. That is, the main fluid valve and pilot valve need not be re-designed or reconfigured in order to work with the switching mechanism and interface of the present invention.

In accordance with the present invention, the end of stroke valve receives end of stroke signals from the pilot valve and converts those end of stroke signals to electric signals. The end of stroke valve then communicates the electric signals to the control system which is sending timed switch signals to the solenoid valve. The solenoid valve has two positions: a left position and a right position. The solenoid valve switches positions upon receiving an electric signal from the control system. The signals sent to the control system or controller from the end of stroke valve indicate to the controller or the operator when the pump is reaching the end of its stroke and, therefore, whether the next timed signal sent to the solenoid valve by the controller will coincide with the end of a stroke of a pump, or, if the pump will not be at the end of its stroke and therefore not operating at full capacity. In the event the controller is programmed by the operator to switch the pump in the middle of the stroke, the controller can simply alert the operator with an "insufficient time delay" message or provide a visual "override?" or an "adjust time delay" option.

The operation of the solenoid valve is coupled to the main fluid valve which also has left and right positions. When the solenoid valve is switched to the left position, the main fluid valve is switched to the left position and when the solenoid valve is switched to the right position, the main fluid valve is switched to the right position as well.

Accordingly, the solenoid valve is connected to the controller, the main fluid valve, and the compressed fluid supply that powers the pump and the end of stroke valve. The end of stroke valve is connected between the pilot valve and the controller. The controller is connected between the end of stroke valve and the solenoid operator. The controller can also receive input from the operator.

In an embodiment, the solenoid valve comprises an inlet port which is in communication with the compressed fluid supply that powers the pump. The solenoid valve also includes a left solenoid outlet port and a right solenoid outlet port. The main fluid valve comprises a left pilot signal port and a right pilot signal port. When the solenoid valve is in the left position by the controller, the solenoid valve provides communication from the solenoid inlet port (which in turn is in communication with the compressed fluid supply), through the left solenoid outlet port and to the left pilot signal port of the main fluid valve. As a result, the main fluid valve is switched to the left position. When the solenoid valve is switched to the right position by the controller, the solenoid valve provides communication between the solenoid inlet port (which is in communication with the compressed fluid supply), through the right solenoid outlet port to the right pilot signal port of the main fluid valve thereby switching the main fluid valve to the right position.

In an embodiment, the solenoid valve further comprises a solenoid operator that is connected to the controller. The solenoid operator shifts the solenoid valve between the right and left positions upon receiving an electric signal from the controller.

In an embodiment, the end of stroke valve further comprises a first switch for generating a first electric signal upon receiving a first end of stroke signal from the pilot valve. The end of stroke valve further comprises a second switch for generating a second electric signal upon receiving a second end of stroke signal from the pilot valve. The switches from the end of stroke valve are both connected to the controller. Meanwhile, the controller is sending signals to the solenoid operator.

In an embodiment, the solenoid valve further comprises a spring retainer to bias the solenoid valve in either the left or the right position. In such an embodiment, the solenoid operator applies an electric signal to the solenoid valve to switch the valve out of its biased position and into its unbiased position. To switch the solenoid valve from its unbiased position to its biased position, the solenoid operator removes the electric signal from the solenoid valve.

In an embodiment, the end of stroke valve comprises an inlet port that is connected to the pilot valve. The inlet port provides communication between the pilot valve and a chamber, the chamber is disposed between the inlet port and a switch. The chamber further houses a piston that is biased towards the inlet port but moves towards the switch and causes the switch to generate an electric signal when an end of stroke signal is communicated from the pilot valve.

In an embodiment, the switches of the end of stroke valve are proximity switches.

In an embodiment, the switching mechanism of the present invention is provided in the form of a retrofit kit which includes the controller, the solenoid valve, the end of stroke valve and the necessary connections between the solenoid valve, the main air valve, the compressed fluid supply and the necessary connections between the end of stroke valve, the controller, the solenoid valve and the pilot valve.

In an embodiment, the present invention provides a switching mechanism for a diaphragm pump that is powered by a pressurized fluid supply. The pump includes a main fluid valve having a left position with the main fluid valve provides communication between the pressurized fluid supply and a left chamber which thereby shifts the pump to the left. The main fluid valve also has a right position where the main fluid valve provides communication between the pressurized fluid supply and a right chamber thereby shifting the pump to the right. The main fluid valve also includes a left pilot signal port for receiving pressurized fluid for shifting the main fluid valve to the left position and a right pilot signal port for receiving pressurized fluid for shifting the main fluid valve to the right position. The pump also includes a pilot valve which communicates a first end of stroke signal through a first pilot outlet port indicates the pump has been fully shifted to the left. The pilot valve also communicates a second end of stroke signal through a second pilot outlet port that indicates the pump has been fully shifted to the right.

The switching mechanism of the present invention comprises a solenoid valve and comprising a solenoid inlet port in fluid communication with the pressurized fluid supply and a solenoid operator that is in electrical communication with a controller. The solenoid valve has a left position where the solenoid valve provides communication between the left pilot signal port of the main fluid valve and the pressurized fluid supply. The solenoid valve also has a right position where the solenoid valve provides communication between the right pilot signal port of the main fluid valve and the pressurized fluid supply. The controller sends signals to the solenoid operator to switch the solenoid valve.

The switching mechanism also includes an end of stroke valve that comprises a first switch for generating a first electric signal upon receiving the first end of stroke signal from the pilot valve and a second switch for generating a second electric signal upon receiving the second end of stroke signal from the pilot valve. The first and second end of stroke signals are sent to the controller.

The solenoid operator is connected to the controller. Upon receiving a signal from the controller, the solenoid operator causes the solenoid valve to switch from the left position to the right position or from the right position to the left position.

In an embodiment, the end of stroke valve comprises a first inlet port and a second inlet port. The first inlet port is connected to the first pilot outlet port and the second inlet port is connected to the second pilot outlet port. Each inlet port of the end of stroke valve leads into a chamber which houses a piston. A switch, preferably in the form of a proximity switch, is disposed at an opposing end of each chamber. Thus, when a first end of stroke signal is communicated from the first pilot outlet port to the first inlet of the end of stroke valve, the piston disposed in the chamber connected to the first inlet port is driven towards the distal end of the chamber towards its respective switch, or first switch. The first switch is then activated which sends a first electric signal to the controller. Similarly, when a second end of stroke signal is communicated from the pilot valve through the second pilot outlet port to the first inlet port of the end of stroke valve, fluid enters the chamber and drives the piston disposed therein towards the distal end of the chamber and towards the switch which generates the second electric signal. The second electric signal is then transmitted to the controller. The controller than compares the end of stroke signals received from the end of stroke valve and can provide an indication to the operator or use when the pump is not able to take a full stroke or operate at full capacity due to an improper timing interval that has been input to the controller.

In an embodiment, the present invention provides a method of converting a fluid power diaphragm pump from a pneumatic shifting mechanism to an electric shifting mechanism. The method includes the steps of providing a controller, providing an end of stroke valve for converting pneumatic end of stroke signals produced by the pilot valve into electric signals, providing a solenoid valve for switching the main fluid valve, providing a solenoid operator for switching the solenoid valve in response to receiving signals from the controller, connecting the solenoid valve to the pressurized fluid supply, the main air valve and the end of stroke valve, connecting the end of stroke valve to the pilot valve, and connecting both the solenoid operator and end of stroke valve to the controller.

In an embodiment, the method includes the steps of connecting a solenoid inlet port of a solenoid valve to the pressurized fluid supply. The method also includes the step of connecting a left solenoid outlet port of the solenoid valve to a left pilot signal port of the main fluid valve and further connecting a right solenoid outlet port of the solenoid valve to the right pilot signal port of the main fluid valve. The method further includes the steps of connecting an end of stroke valve to the first and second pilot outlet ports of the pilot valve, connecting the first and second switches of the end of stroke valve to the controller and connecting the controller to the solenoid operator.

In an embodiment, the method of the present invention provides an improved diaphragm pump that is connected to a controller. The pump further comprises a pilot valve comprising a pilot inlet port and an actuator pin. The actuator pin has a right end and a left end. The pump also comprises an end of stroke valve which includes a first switch for generating a first electric signal and a second switch for generating a second electric signal. The pump also comprises a solenoid valve which, in turn, comprises a solenoid inlet port and a solenoid operator. The solenoid operator is connected to the controller while the controller is connected to the first and second switches of the end of stroke valve. The pump also comprises a main fluid comprising a right inlet port, a left inlet port, a right pilot signal port and a left pilot signal port. The pump further comprises a diaphragm rod comprising a right end connected to a right diaphragm assembly and a left end connected to a left diaphragm assembly. The right diaphragm assembly is disposed inside a right pump chamber and the left diaphragm assembly is disposed inside a left diaphragm chamber.

The pressurized fluid supply is in communication with the pilot inlet port, the solenoid inlet port, and the right and left inlet ports of the main fluid valve.

The solenoid valve has a left position where the solenoid valve provides communication between the left pilot signal port of the main fluid valve and the fluid supply. The solenoid valve also has a right position where the solenoid valve provides communication between the right pilot signal port of the main fluid valve and the fluid supply. The solenoid operator causes the solenoid valve to switch from the left position to the right position upon receiving the first electric signal from the controller. Upon receiving signals from the controller, the solenoid operator causes the solenoid valve to switch from the right position to the left position upon receiving the second electric signal from the end of stroke valve.

The main fluid valve provides communication between the left chamber and the fluid supply when the fluid is being communicated from the solenoid valve to the left pilot signal port. The main fluid valve provides communication between the right chamber and the fluid supply when fluid is being communicated from the solenoid valve to the right pilot signal port.

The right assembly engages the right end of the actuator pin when the diaphragm rod has been shifted a full stroke to the left as the left chamber is filled with pressurized fluid. The engagement of the right end of the actuator pin by the right assembly causes the pilot valve to shift to the left and the end of stroke valve to generate a first electric signal. The first electric signal is communicated to the controller. The controller can be programmed to compare the end of stroke signal with the time interval that has been selected by the customer. If the selected time interval will result in the pump not completing a full stroke, the controller can also be programmed to provide an "override?" or "adjust time delay?" message to the system operator.

The left diaphragm assembly engages the left end of the actuator pin when the diaphragm rod has been shifted a full stroke to the right as the right chamber is filled with pressurized fluid. The engagement of the left end of the actuator pin by the left assembly causes the pilot valve to shift to the right and the end of stroke valve to generate a second electric signal. Like the first electric signal, the second electric signal also is communicated to the controller.

It is therefore an advantage of the present invention to provide an electric shifting mechanism and control system interface for fluid power diaphragm pumps.

Another advantage of the present invention is that it provides an electric shifting mechanism for fluid powered diaphragm pumps which may be added to existing fluid power diaphragm pumps without any significant re-design of the pilot valve or main fluid valve.

Another advantage of the present invention is that it provides a method of retrofitting an existing a diaphragm pump from a pneumatic shifting mechanism to an electric shifting mechanism.

Other objects and advantages of the present invention will become apparent to those skilled in the art upon reviewing the following detailed description, drawings and appended claims.

BRIEF DESCRIPTION OF THE DRAWINGS

For a more complete understanding of the present invention, reference should now be made to the embodiments Illustrated in greater detail in the accompanying drawings and described below by way of examples of the invention.

In the drawings.

Figure 1:
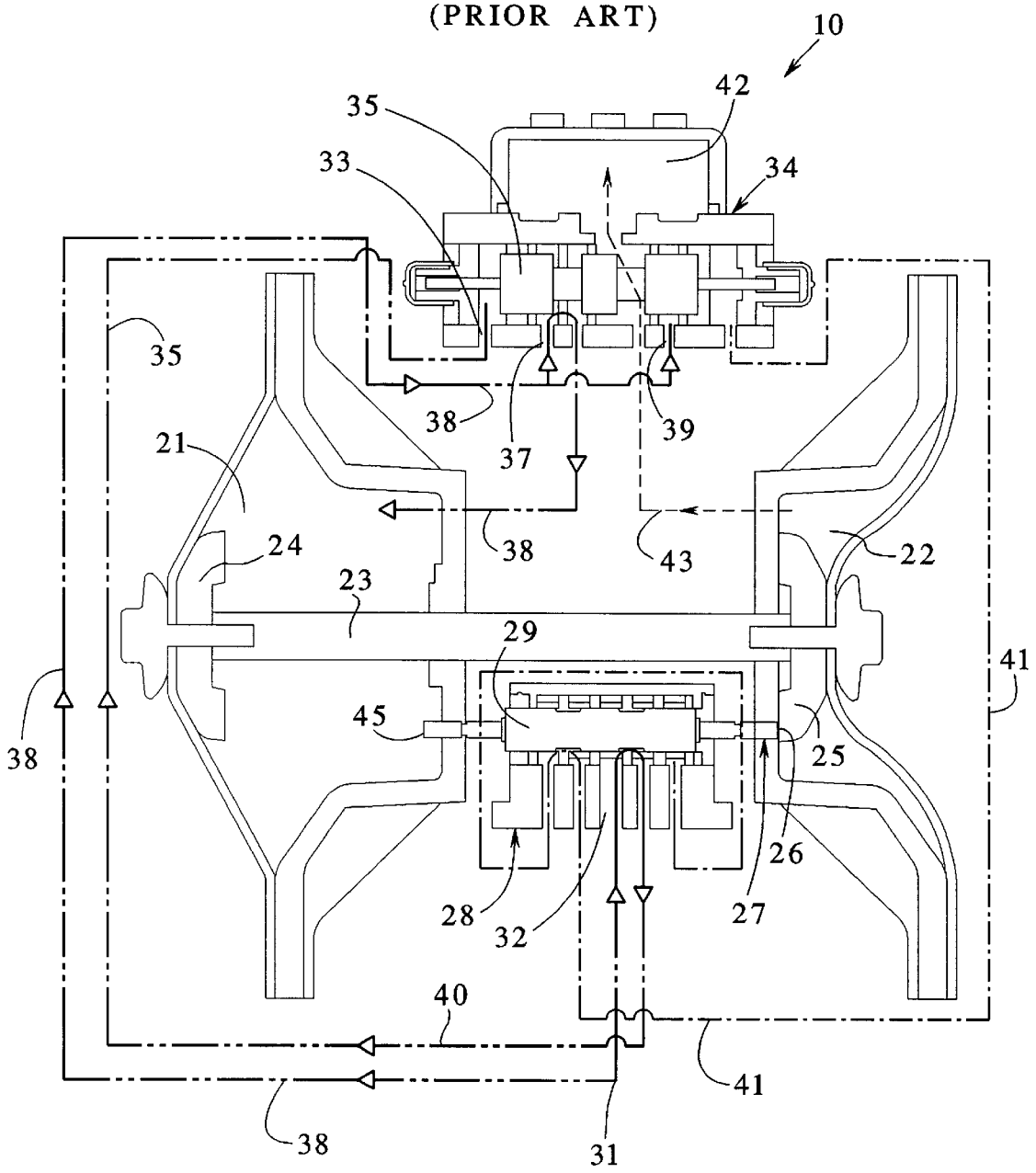
FIG. 1 (PRIOR ART)
FIG. 1 is a schematic illustration of a pneumatic shifting mechanism of a prior art diaphragm pump, particularly illustrating the pump at the end of a stroke in the left direction.

From the above description it is apparent that the objets of the present invention have been achieved. While only certain embodiments have been set forth, alternative embodiments and various modifications will be apparent from the above description to those skilled in the art. These and other alternatives are considered equivalents and within the spirit and scope of the present invention.

DESCRIPTION OF THE PRESENTLY PREFERRED EMBODIMENTS

Like reference numerals will be used to describe like or similar parts from figure to figure in the following description of the drawings. Particularly, like reference numerals will be used to describe like or similar parts from the prior art pump 10 described in FIGS. 1 and 2 and the modified pump 20 described in FIGS. 3 and 4.

Turning first to FIG. 1, a pump is illustrated which includes a left chamber 21 and a right chamber 22. A diaphragm rod 23 connects a left inner diaphragm plate 24 to a right inner diaphragm plate 25. As the rod 23 moves all the way to the left in FIG. 1, the right inner plate 25 engages a right end 26 of an actuator pin 27. The actuator pin 27 is a part of the pilot valve assembly 28. In the position shown in FIG. 1, the pilot valve spool 29 has been shifted to the left.

Compressed air or compressed fluid is provided from a compressed fluid supply shown diagonally at 31. Fluid enters the pilot valve assembly 28 through a pilot inlet port 32. With the spool 29 moved to the left position as shown in FIG. 1, the pilot valve 28 communicates compressed fluid to a left pilot signal port 33 of the main fluid distribution valve 34. This communication is illustrated by the line shown at 40. A result of the pilot signal being communicated from the pilot valve 28 to the left pilot signal port 33 of the main air valve 34. The main air valve spool 36 is shifted to the right as shown in FIG. 1. In this position, compressed fluid which is communicated from the compressed fluid supply 31 through the left inlet port 37 of the main fluid valve 34 is transmitted to the left chamber 21 as shown by the line 38. Compressed fluid is also communicated to the right inlet port 39 of the main fluid valve 34, but this inlet port 39 is blocked by the spool 35 as shown in FIG. 1.

While the left chamber 21 is being filled with compressed fluid (see line 38), the right chamber 22 is being vented through the exhaust port 32 of the main fluid valve 34 as shown by the line 43. The line 41 represents exhausted air from the pilot valve 28.

As indicated above, an end of stroke signal is transmitted from the pilot valve 28 to the left pilot signal port 33 of the main fluid valve 34. This causes the spool 35 to shift to the right and assume the position shown in FIG. 2.

Figure 2:
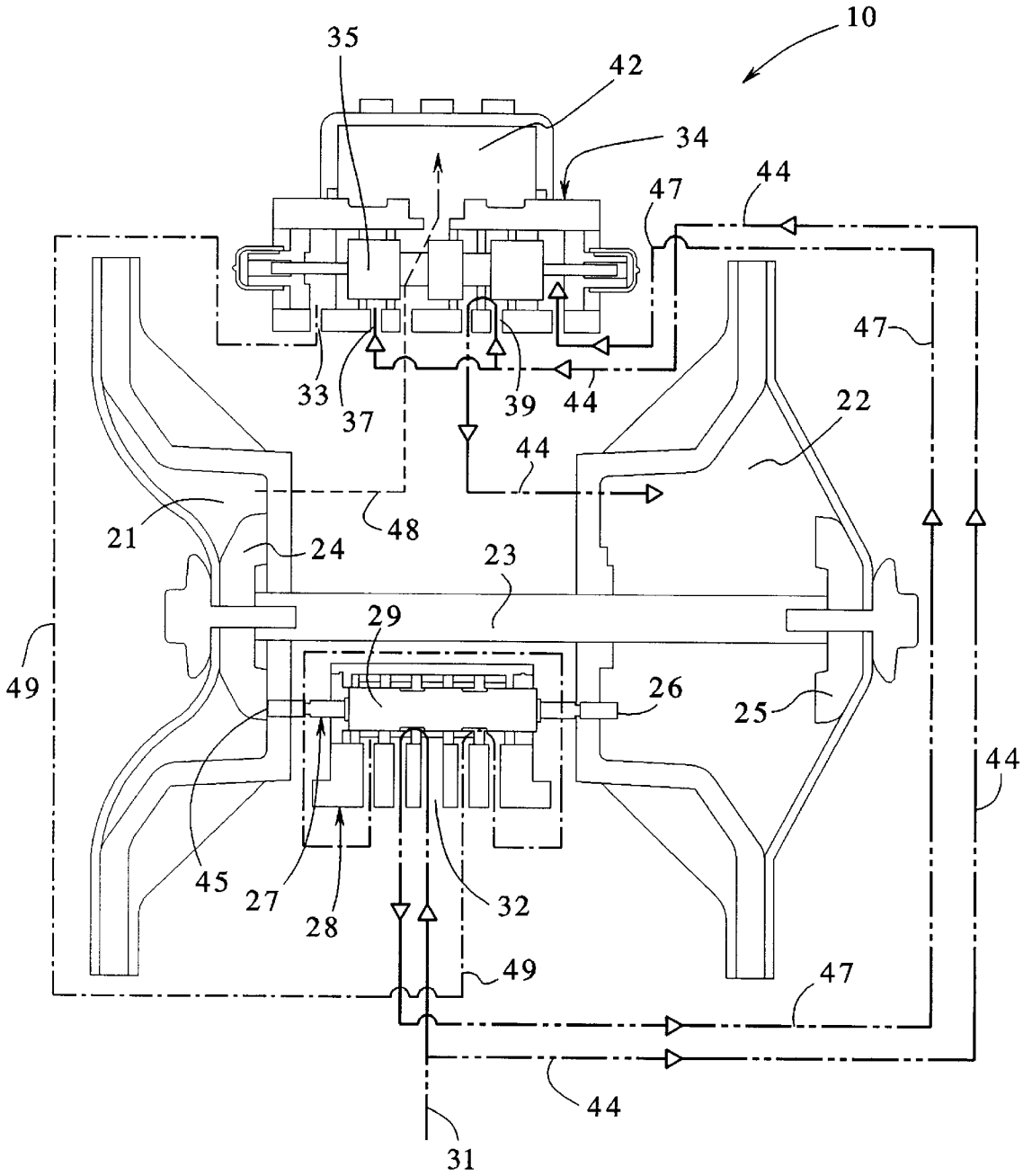
FIG. 2 (PRIOR ART)
FIG. 2 is a schematic diagram of the prior art pump shown in FIG. 1, particularly illustrating the pump at the end of a stroke in the right direction.

Turning to FIG. 2, the spool 35 of the main fluid valve 34 has been shifted to the right thereby blocking entry of compressed fluid through the left inlet port 37 and permitting compressed fluid to enter the valve 34 through the right inlet port 39. As a result, compressed fluid is communicated from the compressed fluid supply 31 to the right chamber 22 as indicated by the line 44. The line 49 represents pilot valve exhaust air.

As shown in FIG. 2, the right chamber 22 is substantially full and the left diaphragm inner plate 24 has moved to the right and engaged the left end 45 of the actuator pin 27. This has caused the spool 29 of the pilot valve 28 to move to the right. As a result, an end of signal port is transmitted from the pilot valve 28 to the right pilot signal port 46 of the main air valve 34 as shown by the line 47. This action, in turn, causes the spool 35 of the main air valve 34 to shift to the left and assume the position shown in FIG. 1. However, with the spool 35 in the position as shown in FIG. 2, it will be noted that the left inlet port 37 is blocked and the compressed air flows through the right inlet 39 and into the right chamber 22 as indicated by the line 44. Air from the right chamber 21 is vented through the exhaust port 42 as indicated by the line 48.

In summary, FIGS. 1 and 2 are shifted pneumatically, i.e. by a pneumatic signal generated by the pilot valve 28. While attempts at providing an electric shifting mechanism had been made in the past, such attempts have typically failed due to the timing problem. Specifically, if a timer is employed and the frequency of the timer not exactly match the timing of the pump 10, there is no way for the pump 10 to operate at full capacity. While the pump 10 as shown in FIGS. 1 and 2 is capable of operating quite efficiently, there is no easy way to couple the pump 10 to an electronic control or monitoring panel. As stated above, there is a need to interface fluid powered pumps with electronic controls and monitoring equipment because the frequency at which the pump operates is extremely useful information.

Figure 3:
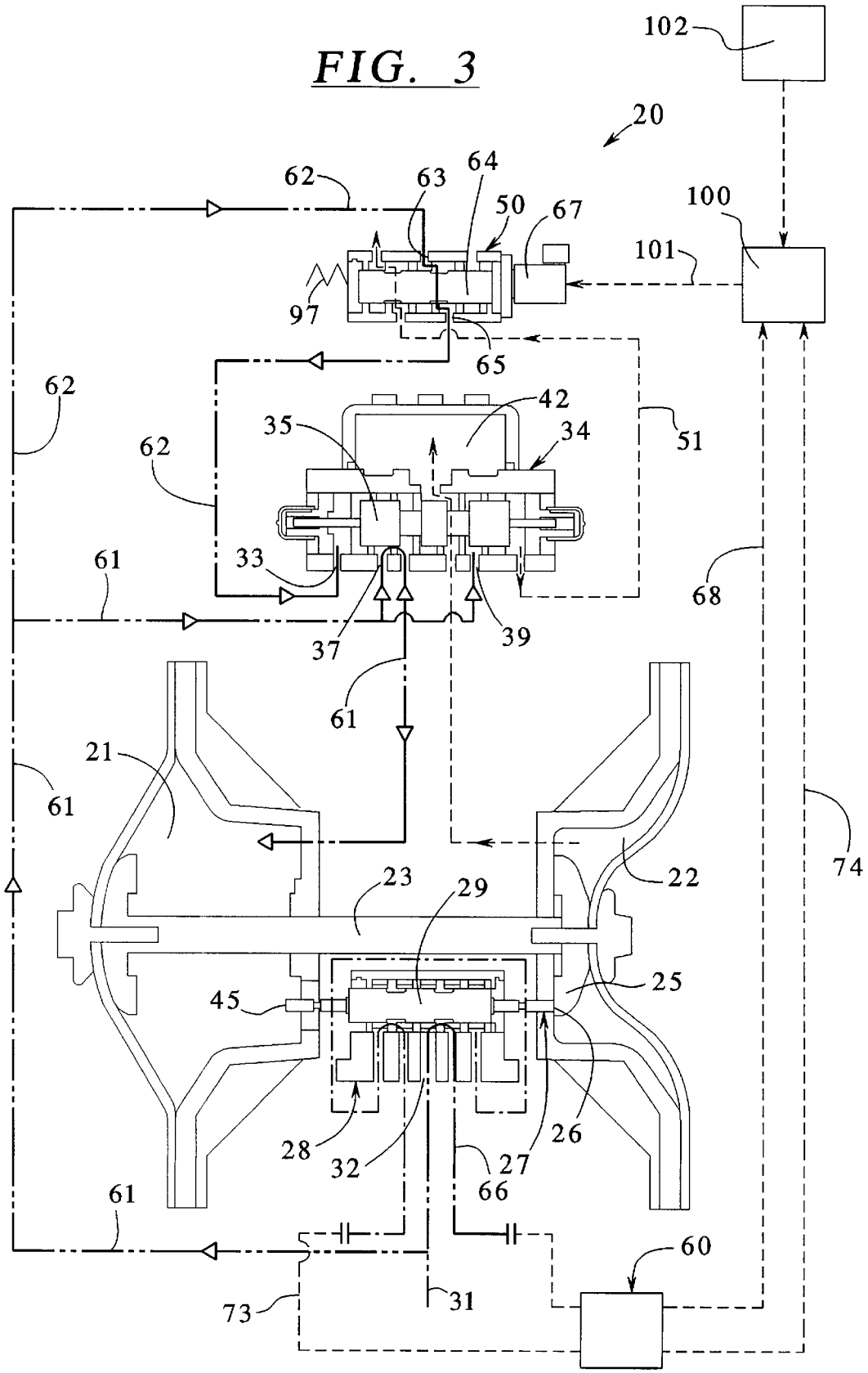
FIG. 3 is a schematic illustration of a fluid power diaphragm pump equipped with an electric shifting mechanism made in accordance with the present invention and particularly illustrating the pump at the end of a stroke in the left direction.
Figure 4:
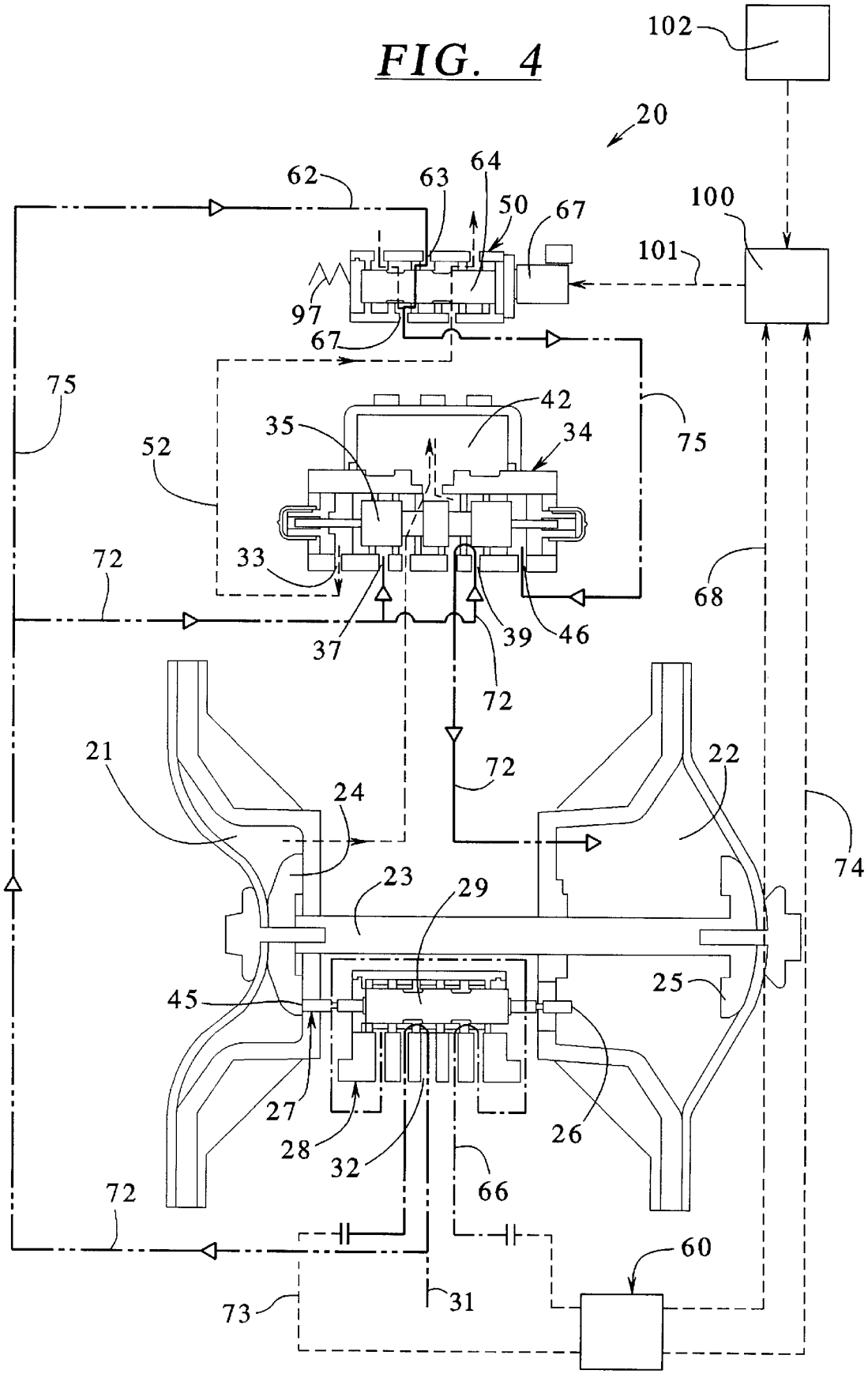
FIG. 4 is another schematic illustration of the pump shown in FIG. 3, particularly illustrating the pump at the end of a stroke in the right direction.
Figure 5:
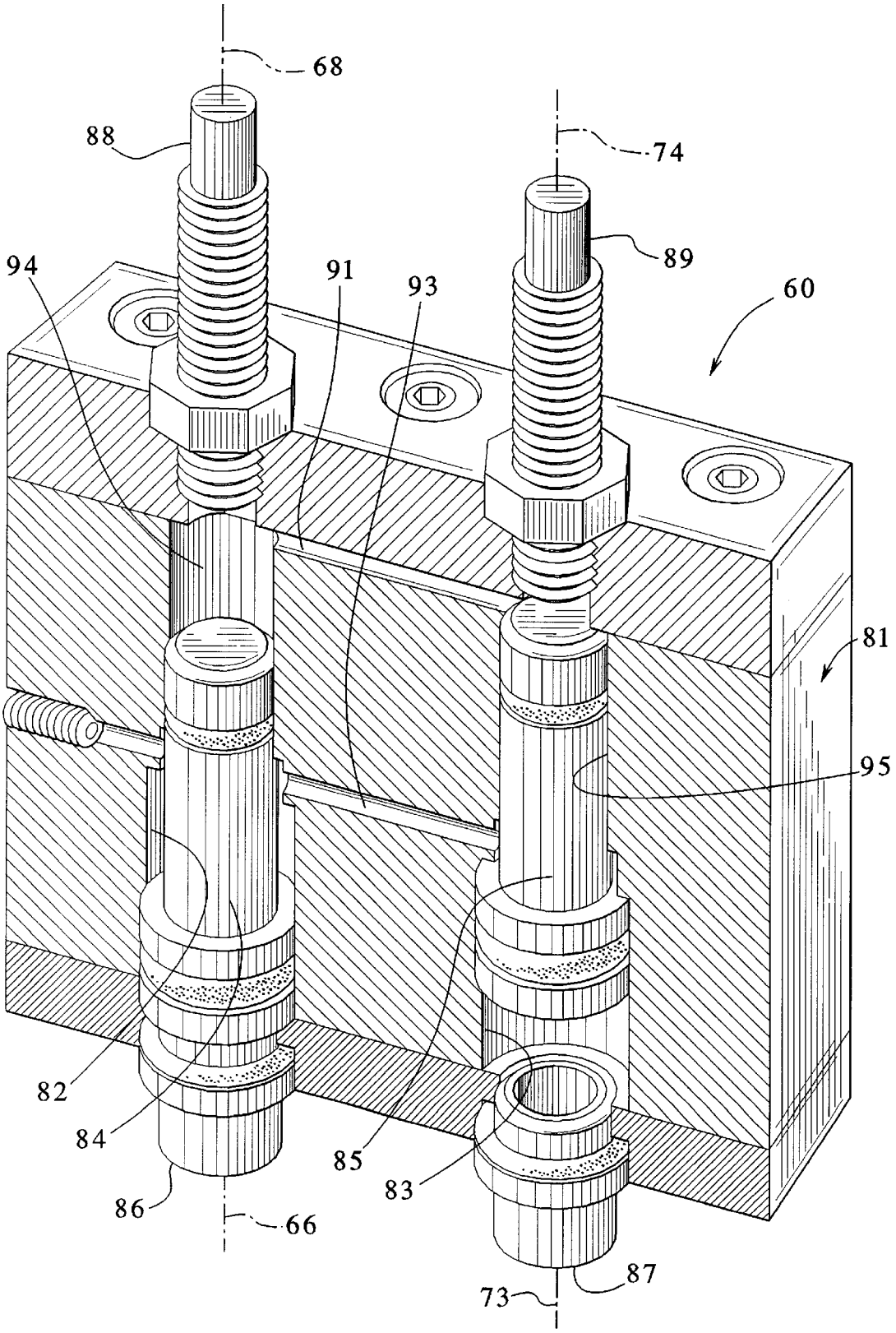
FIG. 5 is a partial perspective view of an end of stroke valve of the shifting mechanism illustrated in FIGS. 3 and 4 above.

To address this problem, the inventors of the present invention developed the solenoid valve 50 and end of stroke valve 60 that are coupled to the controller 100 as illustrated in FIGS. 3–5. As indicated above, the solenoid valve 50, end of stroke valve 60 and controller 100 may be incorporated into the existing fluid power diaphragm pump 10 illustrated in FIGS. 1 and 2.

Turning to FIG. 3, like the pump 10 as illustrated in FIG. 1, air has been communicated from a compressed air supply 31, through the pilot valve inlet port 32 and into the left inlet port 37 of the main fluid valve 34 as indicated by the line 61. Because the spool 35 has been shifted to the right, the right inlet port 39 is blocked. Consequently, the main valve 34 routes the compressed fluid through the left inlet port 37 and into the left chamber 21 (see the line 61). However, as indicated by the line 62, the solenoid valve 50 is also in communication with the compressed fluid supply 31. Specifically, compressed fluid enters through the solenoid inlet 63. Because the solenoid valve spool 64 is in a left position, the solenoid valve 50 routes compressed fluid through the solenoid inlet port 63, through the left solenoid outlet port 65, and into the left pilot signal port 33 of the main air valve 34. This communication causes the spool 35 of the main valve 34 to move to the right and assume the position shown in FIG. 3 which, in turn, permits compressed air to be routed by the main valve 34 into the left chamber 21 as indicated by the line 61.

Instead of directly shifting the main fluid valve 34 with an end of stroke pneumatic signal from the pilot valve 28, the solenoid valve 50 actually shifts the main fluid valve 34 upon receiving a signal from the controller 100 which receives instruction from the operator input 102, which may be a keyboard or keypad. The switch signal is transmitted to the solenoid operator 67 over the wire 101 or other suitable transmission device.

The solenoid operator 67 shifts the solenoid spool 64 so that compressed fluid is then communicated through the solenoid inlet 63 to the right solenoid outlet 67 as indicated in FIG. 4. The right solenoid outlet 67 is connected or is in communication with the right pilot signal port 46 of the main fluid valve 34. This action will, in turn, shift the main air valve spool 35 from its right position shown in FIG. 4 back to the left position shown in FIG. 3. The main air valve 34 is exhausted through the solenoid valve 50 as indicated by the line 51.

The diaphragm rod 23 as shown in FIG. 3 has moved to the left and the right diaphragm inner plate 25 has engaged the right end 26 of the actuator pin 27. This causes the spool 29 of the pilot valve 28 to move to the left which thereby permits an end of stroke signal to be generated by compressed air entering the pilot valve 28 through the pilot inlet port 32 as indicated by the line 66. The end of stroke signal is thereafter communicated to the end of stroke valve 60. As described in greater detail below, the end of stroke valve 60 converts the first pneumatic end of stroke signal generated by the pilot valve 28 into a first electric signal which is communicated to the controller 100 over a hard wire 68 or other suitable connecting mechanism (such as radio frequency or other non-hard-wire communication means). Upon receiving the first electric signal from the end of stroke valve 60, the controller compares the first signal indicating that the pump is at the end of its stroke with the time interval that has been programmed by the operator by way of the input 102. If the controller calculates that the requested time interval will not permit the pump to complete its upcoming stroke or otherwise will not permit the pump to operate at full capacity, the controller can be programmed to send an appropriate signal to the operator by way of an alarm or an "override?" or "adjust time delay?" prompt.

FIG. 4 also indicates the generation of a second electric signal or second end of stroke signal. Specifically, compressed fluid has been communicated from the compressed fluid supply 31 to the right inlet port of the main air valve 34 as indicated by the line 72. With the position of the spool 35 towards the right as shown in FIG. 4, the compressed fluid is then communicated from the main fluid valve 34 to the right chamber 22. This action causes the diaphragm rod 23 to shift to the right which results in the left inner diaphragm plate 24 engaging the left end 45 of the actuator pin 27 as indicated in FIG. 4. The spool 29 of the pilot valve 28 will thereafter be shifted to permit the generation of a second end of stroke signal which is communicated through the pilot valve inlet 32 and to the end of stroke valve 60 as indicated by the line 73. Upon receiving the second pneumatic end of stroke signal from the pilot valve 28, the end of stroke valve 60 converts the pneumatic signal to a second electric signal and communicates the second electric signal to the controller 100 by way of a hard wire 74 or other suitable transmission means. Upon receiving the second electric signal from the end of stroke valve 60, the controller makes the same comparison discussed above. Upon receiving a signal from the controller 100, the solenoid operator 67 will shift the solenoid valve spool 64 from the right position shown in FIG. 4 where fluid is routed to the right pilot signal port 46 (see line 75) back to the left position shown in FIG. 3. Again, the main air valve 34 is exhausted through the solenoid valve 50 as indicated by the line 52.

Thus, the end of stroke valve 60 converts the two pneumatic end of stroke signals communicated from the pilot valve 28 into first and second electric signals which are thereafter transmitted to the controller. The controller 100 sends signals to the solenoid operator 67 which shifts the solenoid spool 64 of the solenoid valve 50. The solenoid valve 50 is in communication with the compressed fluid supply 31 and the shifting of the solenoid valve 50, upon receipt of an electric signal from the controller 100, effectively converts the electric signal transmitted by the controller 100 back to a pneumatic signal for shifting the main air valve 34.

Turning to FIG. 5, an example of an end of stroke valve 60 is illustrated. The valve 60 includes a body 81 which includes chambers 82, 83. Each chamber 82, 83 accommodates a piston 84, 85 The body 81 also accommodates a first inlet port 86 and a second inlet port 87. Disposed at an opposing end of the first chamber 82 is a first proximity switch 88; disposed at a distal end of the second chamber 83 is a second proximity switch 89. Passageways 91 and 93 provide communication between the first and second chambers 82, 83.

In operation, when a first end of stroke signal is communicated from the pilot valve 28 to the first inlet port 86 as indicated by the line 66, the pneumatic pressure will force the piston 84 upwards towards the first proximity switch 88. Fluid disposed between the piston 84 and the proximity switch 88 will be communicated through the passageway 91 to force the second piston 85 downward. The proximity switch 88 is activated and a first electric signal is transmitted to the solenoid operator 67 over the wire 68 or other suitable transmission means.

Returning to FIGS. 3 and 4, the solenoid valve 50 also includes a spring retainer 97 for biasing the solenoid valve spool 64 in either the left or the right position.

Similarly, when a second end of stroke signal is generated by the pilot valve 28 and communicated to the second inlet 87 as indicated by the line 73, the fluid pressure will cause the piston 85 to move upward as shown in FIG. 5. Again, fluid pressure communicated to the passageway 91 causes the piston 84 to drop downward as shown in FIG. 5. The passageway 93 equalizes the pressure between the chambers 82 and 83. Similarly, passageway 91 equalizes the pressure between the upper chambers 94, 95.

It will be noted from FIGS. 3 and 4, that the first and second electric signals are easily monitored by the controller 100. By monitoring the frequency of the first and second electric signals, the operator can easily monitor the speed of the pump.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood to those of ordinary skill in the art, of course, that the invention is not necessarily limited to the particular embodiments illustrated herein.

What is claimed is:

1. A diaphragm pump powered by a pressurized fluid supply, the pump comprising:

a pilot valve comprising a pilot inlet port and an actuator pin, the actuator pin having a second end and a first end, an end of stroke valve comprising a first switch for generating a first electric signal and a second switch for generating a second electric signal, an electric valve comprising an inlet port and a operator, the operator being connected a controller, the controller being connected to the first and second switches of the end of stroke valve, a main fluid valve comprising a second inlet port, a first inlet port, a second pilot signal port and a first pilot signal port, a diaphragm rod comprising a first end connected to a first diaphragm assembly and a second end connected to a second diaphragm assembly, the first diaphragm assembly being disposed inside a first chamber and the second diaphragm assembly being disposed inside a second chamber, the fluid supply being in communication with the pilot inlet port, the electric inlet port and the first and second inlet ports of the main fluid valve, the electric valve having a first position where the electric valve provides communication between the first pilot signal port of the main fluid valve and the fluid supply, the electric valve having a second position where the electric valve provides communication between the second pilot signal port of the main fluid valve and the fluid supply, the operator causing the electric valve to shift from the first position to the second position upon receiving a timed signal from the controller, the main fluid valve being providing communication between the first chamber and the fluid supply when fluid is being communicated from the electric valve to the first pilot signal port, the main fluid valve being providing communication between the second chamber and the fluid supply when fluid is being communicated from the electric valve to the second pilot signal port, the controller being programmed to compare the end of stroke signals received from the pilot valve assembly with pre-programmed timed switch signals and, the controller being programmed to provide an indication if the controller is programmed to switch the electric valve before the controller receives a next end of stroke signal from the pilot valve assembly.

2. A method converting a fluid powered diaphragm pump from a pneumatic shifting mechanism to an electric shifting mechanism with a system interface, the pump being powered by a pressurized fluid supply, the pump including a plurality of chambers, a main fluid valve for selectively communicating pressurized fluid to one of the chambers, and a pilot valve which generates pneumatic end of stroke signals, the method comprising the following steps:

connecting an inlet port of an electric valve to the pressurized fluid supply, the electric valve comprising a first outlet port, a second electric outlet port and an operator, connecting the first electric outlet port of the electric valve to the first pilot signal port of the main fluid valve, the electric valve having a first position where the electric valve provides communication from the pressurized fluid supply, through the electric inlet port, through the first electric outlet port and to the first pilot signal port of the main fluid valve, connecting the second electric outlet port of the electric valve to the second pilot signal port of the main fluid valve, the electric valve having a second position where the electric valve provides communication from the pressurized fluid supply, through the electric inlet port, through the second electric outlet port and to the second pilot signal port of the main fluid valve, providing a controller programmed to send timed switch signals to the operator of the electric valve, connecting the controller to the operator of the electric valve, connecting an end of stroke valve to the first and second pilot outlet ports of the pilot valve, the end of stroke valve comprising a first switch for generating a first electric signal upon receiving the first end of stroke signal from the pilot valve and a second switch for generating a second electric signal upon receiving the second end of stroke signal from the pilot valve, connecting the controller to the first and second switches of the end of stroke valve, programming the controller to compare the first and second electric signals received from the end of stroke valve with the timed switch signals, programming the controller to provide to provide an indication if the controller is programmed to switch the electric valve before the controller receives a next end of stroke signal from the pilot valve assembly.

3. A method converting a fluid powered diaphragm pump from a pneumatic shifting mechanism to an electric shifting mechanism with a system interface, the pump including a plurality of chambers, a main fluid valve for selectively communicating pressurized fluid to one of the chambers, and a pilot valve which generates pneumatic end of stroke signals, the method comprising the following steps:

providing an end of stroke valve for converting pneumatic end of stroke signals produced by the pilot valve into electric end of stroke signals, providing a controller with a programmable timing element that is programmed to switch the pump with timed switch signals, the controller further being programmed to compare the timed switch signals with the electric end of stroke signals generated by the end of stroke valve, providing an electric valve for shifting the main fluid valve, connecting the electric valve to the pressurized fluid supply, the main air valve and the controller, connecting the end of stroke valve to the pilot valve and the controller.

4. A combination shifting mechanism and interface for a diaphragm pump comprising:

a controller electrically coupled to an electric valve and a pilot valve assembly, the controller sending programmable timed switch signals to the electric valve, the pilot valve assembly generating pneumatic end of stroke signals and converting said pneumatic end of stroke signals to electric end of stroke signals, the pilot valve assembly sending said electric end of stroke signals to the controller, the electric valve being in fluid communication with a main fluid valve.

5. The combination shifting mechanism and interface of claim 4 wherein the controller is programmed to compare the electric end of stroke signals received from the pilot valve assembly with the programmed timed switch signals and, the controller being programmed to provide an indication if the controller is programmed to switch the electric valve before the controller receives a next end of stroke signal from the pilot valve assembly.

6. The combination shifting mechanism and interface of claim 5 wherein the indication is an alarm.

7. The combination shifting mechanism and interface of claim 5 wherein the indication is a visual signal.

8. The combination shifting mechanism and interface of claim 4 wherein the electric valve comprises an operator, the operator being connected to the controller, the operator shifting the electric valve upon receiving a switch signal from the controller, the main fluid valve being shifted when the electric valve is shifted.

9. The combination shifting mechanism and interface of claim 4 wherein the electric valve comprises a solenoid valve.

10. The combination shifting mechanism and interface of claim 4 wherein the pilot valve assembly further comprises a pilot valve that generates pneumatic end of stroke signals and an end of stroke valve that converts said pneumatic end of stroke signals to electric signals.

11. The combination shifting mechanism and interface of claim 10 wherein the end of stroke valve further comprises a first switch for generating a first electric signal upon receiving a first end of stroke signal from the pilot valve and a second switch for generating a second electric signal upon receiving a second end of stroke signal from the pilot valve, the controller being connected to the first and second switches of the end of stroke valve.

12. The combination shifting mechanism and interface of claim 8 wherein the electric valve further comprises a spring retainer that biases the electric valve in a first position, upon receiving a first switch signal from the controller, the operator applying current to the electric valve thereby causing the electric valve to shift from the first position to a second position, upon receiving a second switch signal from the controller, the operator cutting off the current to the electric valve thereby causing the spring retainer to shift the electric valve from the second position to the first position.

13. The combination shifting mechanism and interface of claim 10 wherein the end of stroke valve comprises a first inlet port and a second inlet port, the first inlet port being connected to the pilot valve, the first inlet port providing communication between the pilot valve and a first chamber, the first chamber being disposed between the first inlet port and a first switch, the first chamber housing a first piston that is biased towards the first inlet port but which moves towards the first switch and causes the first switch to generate a first electric signal upon the first chamber receiving a first end of stroke signal communicated from the pilot valve, the second inlet port being connected to the pilot valve, the second inlet port providing communication between the pilot valve and a second chamber, the second chamber being disposed between the second inlet port and a second switch, the second chamber housing a second piston that is biased towards the second inlet port but which moves towards the second switch and causes the second switch to generate a second electric signal upon the second chamber receiving a second end of stroke signal communicated from the pilot valve.

14. The combination shifting mechanism and interface of claim 11 wherein the first and second switches are proximity switches.

15. A combination shifting mechanism and interface for a diaphragm pump that is powered by a pressurized fluid supply, the pump including a plurality of chambers, a main fluid valve for selectively communicating pressurized fluid to one of the chambers, and a pilot valve which generates pneumatic end of stroke signals, the combination shifting mechanism and interface comprising:

a controller connected to an electric valve and an end of stroke valve, the controller being programmed to send timed switch signals to the electric valve, the electric valve comprising an electric valve inlet port in communication with the pressurized fluid supply and a operator, the electric valve having a first position where the electric valve provides communication between a first pilot signal port of the main fluid valve and the fluid supply, the electric valve having a second position where the electric valve provides communication between a second pilot signal port of the main fluid valve and the fluid supply, an end of stroke valve comprising a first switch for generating a first electric signal upon receiving the first end of stroke signal from the pilot valve and a second switch for generating a second electric signal upon receiving the second end of stroke signal from the pilot valve, the controller being connected to the first and second switches of the end of stroke valve, the controller being programmed to compare the end of stroke signals received from the first and second switches with the programmed timed switch signals and, the controller being programmed to provide an indication if the controller is programmed to switch the electric valve before the controller receives a next end of stroke signal from the pilot valve assembly.

16. The combination shifting mechanism and interface of claim 15 wherein the electric valve comprises an operator, the operator being connected to the controller, the operator causes the electric valve to shift from the first position to the second position upon receiving a timed switch signal from the controller.

17. The combination shifting mechanism and interface of claim 16 wherein the electric valve further comprises a spring retainer that biases the electric valve in a first position, upon receiving a first switch signal from the controller, the operator applying current to the electric valve thereby causing the electric valve to shift from the first position to a second position, upon receiving a second switch signal from the controller, the operator cutting off the current to the electric valve thereby causing the spring retainer to shift the electric valve from the second position to the first position.

18. The combination shifting mechanism and interface of claim 15 wherein the end of stroke valve comprises a first inlet port connected to the first pilot outlet port, the first inlet port providing communication between the first pilot outlet port and a first chamber, the first chamber being disposed between the first inlet port and the first switch, the first chamber housing a first piston that is biased towards the first inlet port but which moves towards the first switch and causes the first switch to generate the first electric signal upon the first end of stroke signal being communicated to the first chamber, the end of stroke valve further comprises a second inlet port connected to the second pilot outlet port, the second inlet port providing communication between the second pilot outlet port and a second chamber, the second chamber being disposed between the second inlet port and the second switch, the second chamber housing a second piston that is biased towards the second inlet port but which moves towards the second switch and causes the second switch to generate the second electric signal upon the second end of stroke signal being communicated to the second chamber.

19. The combination shifting mechanism and interface of claim 15 wherein the first and second switches each comprise a proximity switch.

20. The combination shifting mechanism and interface of claim 18 further comprising a passageway connecting the first and second chambers at distal ends thereof disposed adjacent to the first and second switches wherein movement of the first piston towards the first switch causing fluid disposed in the first chamber to be communicated through the passageway to the second chamber to bias the second piston towards the second inlet port, and wherein movement of the second piston towards the second switch causing fluid disposed in the second chamber to be communicated through the passageway to the first chamber to bias the first piston towards the first inlet port.

21. The combination shifting mechanism and interface of claim 18 wherein the first and second pistons are disposed vertically above the first and second inlet ports respectively.

22. The combination shifting mechanism and interface of claim 15 wherein the electric valve comprises a solenoid valve.

* * * * *